US007744407B1

(12) United States Patent
Jerry

(10) Patent No.: US 7,744,407 B1
(45) Date of Patent: Jun. 29, 2010

(54) MODULAR CIRCUIT BOXES AND ASSOCIATED COMPONENTS

(76) Inventor: Blurton Jerry, 2810 N. Mayberry Rd., Calumet, OK (US) 73014

( * ) Notice: Subject to any disclaimer, the term of this patent is extended or adjusted under 35 U.S.C. 154(b) by 0 days.

(21) Appl. No.: 12/417,304

(22) Filed: Apr. 2, 2009

Related U.S. Application Data

(60) Provisional application No. 61/042,146, filed on Apr. 3, 2008.

(51) Int. Cl.
*H01R 13/60* (2006.01)

(52) U.S. Cl. ..... 439/535; 439/107; 174/53; 174/57

(58) Field of Classification Search ..... 439/535, 439/107; 174/53, 57, 50
See application file for complete search history.

(56) References Cited

U.S. PATENT DOCUMENTS

| | | | | |
|---|---|---|---|---|
| 2,397,688 | A | 4/1946 | Osinksi | |
| 2,828,394 | A | 3/1958 | Mayzik | |
| 2,920,303 | A | 1/1960 | Johnson | |
| 3,038,141 | A | 6/1962 | Chiuchiolo | |
| 3,609,647 | A | 9/1971 | Castellano | |
| 3,860,739 | A | 1/1975 | Kloth et al. | |
| 3,879,101 | A | 4/1975 | McKissic | |
| 4,117,258 | A | 9/1978 | Shanker | |
| 4,165,443 | A | 8/1979 | Figart et al. | |
| 4,724,281 | A | 2/1988 | Nix et al. | |
| 5,399,806 | A | 3/1995 | Olson | |
| 5,413,501 | A | 5/1995 | Munn | |
| 6,099,348 | A | 8/2000 | Horton | |
| 6,133,526 | A | 10/2000 | Lebo et al. | |
| 6,227,903 | B1 | 5/2001 | Horton | |
| 6,309,248 | B1 | 10/2001 | King | |
| 6,558,190 | B1 | 5/2003 | Pierson, Jr. | |
| 6,617,511 | B2 | 9/2003 | Schultz et al. | |
| 6,623,296 | B2 | 9/2003 | Okamoto | |
| 6,767,245 | B2 | 7/2004 | King | |
| 6,870,099 | B1 | 3/2005 | Schultz et al. | |
| 6,884,111 | B2 * | 4/2005 | Gorman | 439/535 |
| 7,160,147 | B1 | 1/2007 | Stephan | |
| 7,232,336 | B1 | 6/2007 | Evans et al. | |
| 7,361,051 | B2 * | 4/2008 | Gorman | 439/535 |
| 7,367,121 | B1 | 5/2008 | Gorman | |
| 2006/0054339 | A1 | 3/2006 | Domeyer | |
| 2006/0289192 | A1 | 12/2006 | Johnson et al. | |
| 2008/0087452 | A1 | 4/2008 | Nicholson | |

* cited by examiner

*Primary Examiner*—Gary F. Paumen
(74) *Attorney, Agent, or Firm*—Crowe & Dunlevy

(57) ABSTRACT

Disclosed is a modular circuit system for use in a wiring system. The modular circuit system includes a circuit box and a fitting. The circuit box includes fitting prong receptacles that are in electrical communication with ground, neutral and hot wires from the wiring system. The fitting includes a plurality of prongs configured for insertion into the fitting prong receptacles of the circuit box. The insertion of the fitting prongs into the fitting prong receptacles places the fitting in electrical communication with circuit box. The modularity of the circuit box and fitting permit the exchange of various fittings into the circuit box.

2 Claims, 11 Drawing Sheets

MODULAR CIRCUIT BOXES AND ASSOCIATED COMPONENTS

RELATED APPLICATIONS

The present application claims the benefit of U.S. Provisional Patent Application No. 61/042,146, entitled "Modular Circuit Boxes and Associated Components," filed Apr. 3, 2008, the disclosure of which is herein incorporated by reference.

FIELD OF THE INVENTION

The present invention is generally related to the field of wiring systems, and more particularly to electrical outlet or circuit boxes and their related components.

BACKGROUND OF THE INVENTION

Electrical circuit boxes are used to provide connections within an electrical conduit wiring system. Prior art circuit boxes provide the space behind electrical fittings, such as power outlet sockets and light switches, which is necessary to make the electrical connections between the fitting and the wiring system. Circuit boxes of this type may be referred to as a "pattress" or "pattress box." These circuit boxes are typically installed inside a wall and concealed from view by a cover plate connected to the fitting.

In the past, electrical cables were manually pulled through the circuit box and manually connected to the fitting. This is usually accomplished by connecting the wires directly to the fitting with screws or lugs, or by connecting lead wires to the circuit with wire nuts. In many cases, wires are spliced, stripped and looped in the limited space behind the fitting to make the necessary connections. The connection of the wires in this manner increases the risk that an electrical short will occur as the wires and fitting are placed into the box after connection. Additionally, the placement of the connection behind the fitting frustrates the inspection of the electrical circuit after installation. Utilizing the prior art connection method also makes it more difficult to exchange fittings after the initial installation. For these and other reasons, there is a need for an improved method and mechanism for connecting switches, outlets and other fittings to the electrical wiring system in a building.

SUMMARY OF THE INVENTION

In a preferred embodiment, the present invention is a modular circuit system for use in an electrical wiring system. The modular circuit system includes a circuit box and a corresponding fitting. The circuit box is configured to be connected into the electrical wiring system and preferably includes a housing, a first plurality of wire lugs on a first side of the circuit box, a second plurality of wire lugs on a second side of the circuit box, a plurality of connection bars connected between the first plurality of wire lugs and the second plurality of wire lugs; and a plurality of prong receptacles. Each of the plurality of prong receptacles is connected to a corresponding connection bar.

The fitting is configured to be removably inserted into the circuit box. The fitting includes a base and a plurality of prongs extending from the base. Each of the prongs is configured to be received by a corresponding one of the plurality of prong receptacles, thereby placing the fitting in electrical communication with the circuit box.

The circuit box may take the form of a single switch box, a single outlet box, a double switch box, a double outlet box, a switch-outlet combination box, or a junction box. The fitting may take the form of a single switch jack, a single outlet jack, ceiling fans, smoke detectors, exhaust vents, intake vents or other electrical components typically connected to the electrical wiring system in a building, machine, vessel or vehicle.

DETAILED DESCRIPTION OF PREFERRED EMBODIMENTS

Figure 1:
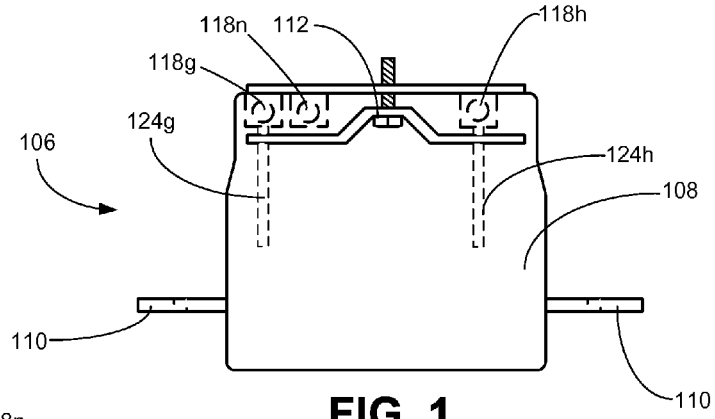
FIG. 1 is a top cross-sectional view of a single switch box constructed in accordance with a preferred embodiment.

In accordance with presently preferred embodiments, the present invention includes a modular circuit system 100 configured to be connected within an electrical wiring system. The modular circuit system 100 generally includes a circuit box 102 and a corresponding fitting 104 configured for removable engagement with the circuit box 102. As used herein, the term "circuit box" will refer broadly to any housing capable of connection to an electrical wiring system and which is suitable for retaining an appropriate fitting. As used herein, the term "fitting" refers to switches, electrical outlets, ceiling fans, smoke detectors, exhaust vents, intake vents or other electrical components typically connected to the electrical wiring system in a building, machine, vessel or vehicle. Components described herein may be manufactured of plastic or metal, depending on the need for electrical conductivity and the particular environment and application in which the components are installed or deployed.

For the purposes of the present disclosure, components within the modular circuit system 100 may be identified reference numeral and "g," "n" and "h" letter designations, which respectively represent a components connected to the ground, neutral and hot lines in the electrical wiring system. Components common to different embodiments may be referred to by the same reference numeral.

Figure 2:
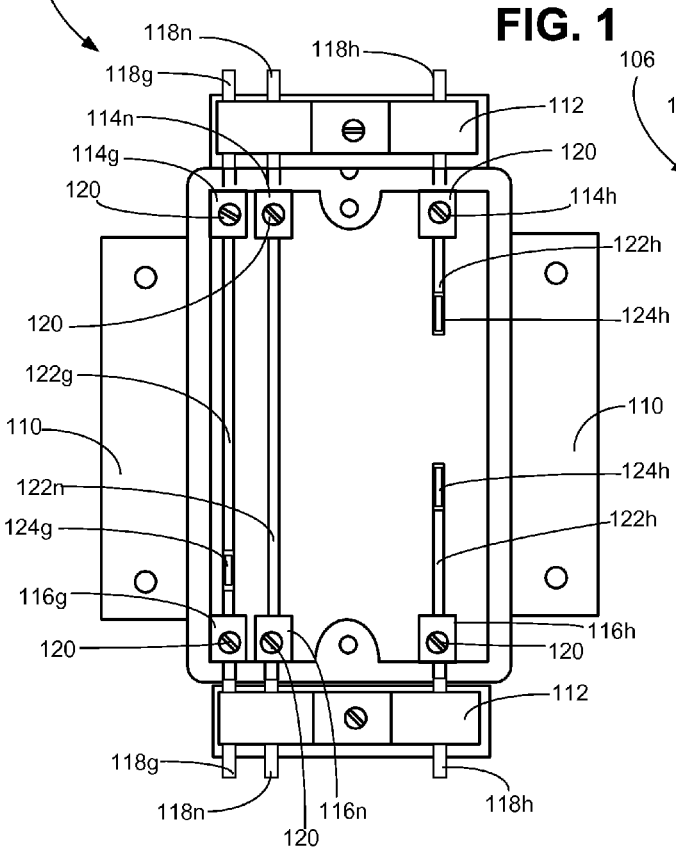
FIG. 2 is a front view the single switch box of FIG. 1.
Figure 3:
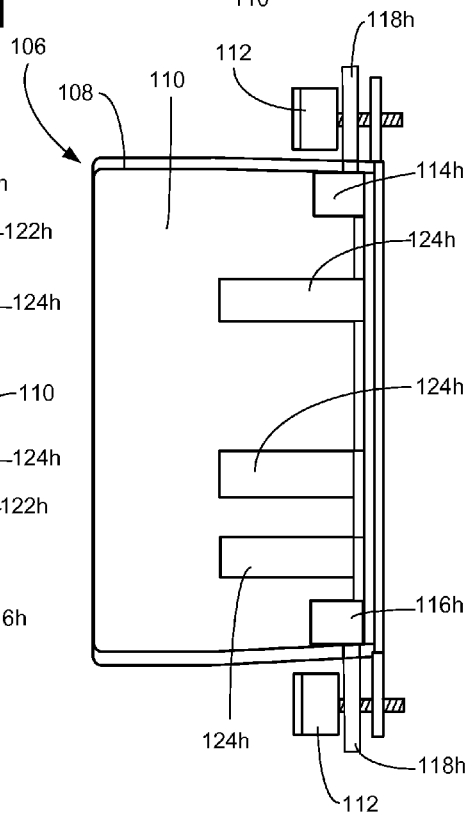
FIG. 3 is a side partial cut-away view of the single switch box of FIG. 1.

In the preferred embodiment depicted in FIGS. 1-3, the circuit box 102 is configured as a single switch box 106. Shown in FIGS. 1-3 are top, front and right side views, respectively, of the single switch box 106 constructed in accordance with a preferred embodiment of the present invention. One side of the single switch box 106 has been removed from FIG. 3 to better illustrate the internal components of the single switch box 106.

The single switch box 106 includes a housing 108 that is preferably manufactured from a suitable plastic. The single switch box 106 preferably includes a pair of fins 110 capable of securing the single switch box 106 to a supporting structural element. When used in connection with an appropriate switch jack, the single switch box 106 regulates the flow of current from the electrical wiring system to downstream circuits or electrical devices.

The single switch box 106 includes wire clamps 112 and lugs 114*g*, 114*n* and 114*h* (collectively "lugs 114") at the top of the housing 108 and lugs 116*g*, 116*n* and 116*h* (collectively "lugs 116") at the bottom of the housing 108. The lugs 114 are configured to accept the stripped ends of the ground wire 118*g*, neutral wire 118*n* and hot wire 118*h* (collectively "wires 118") from the electrical wiring system. The ends of the wires 118 are supported by the clamps 112 and secured to respective lugs 114 and 116 with set screws 120. The single switch box 106 further includes a solid contact bar 122*g* extending between the lugs 114*g* and 116*g*, a solid contact bar 122*n* extending between the lugs 114*n* and 116*n*, and a pair of separated contact bars 122*h* extending between the lugs 114*h* and 116*h* (collectively "contact bars 122"). The contact bars 122*g* and 122*n* are provide current paths between the lugs 114*g*, 114*n* and 116*g*, 116*n*, respectively. The contact bars 122*h* are split and provide a switchable current path when connected to an appropriate switch fitting.

The ground contact bar 122*g* and each of the separated hot contact bars 122*h* include receptacles 124*g* and 124*h*, respectively, extending out from the contact bars 122. Depending on the particular application in which the single switch box 106 is used, it may be useful to embed the contact bars 122 within the back panel of the housing 108 or otherwise insulate the portions of the contact bars 122 other than the receptacles 124.

Figure 4:
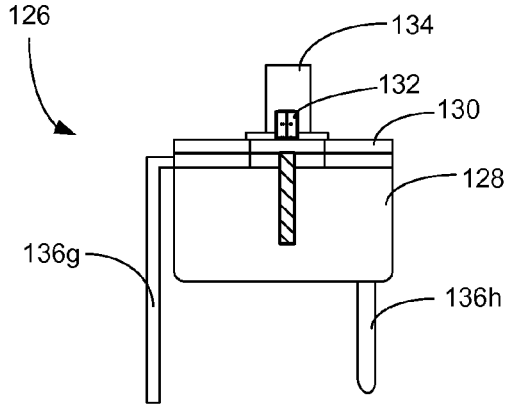
FIG. 4 is a top view of a single switch fitting constructed in accordance with a preferred embodiment.
Figure 5:
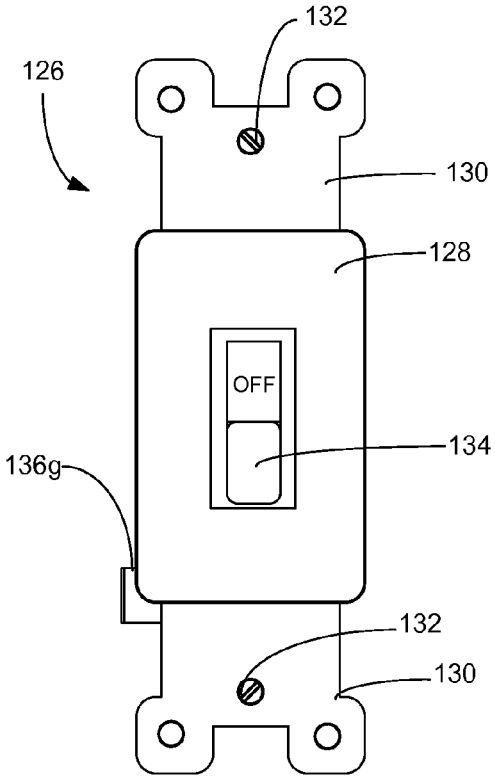
FIG. 5 is a front view of the single switch fitting of FIG. 4.
Figure 6:
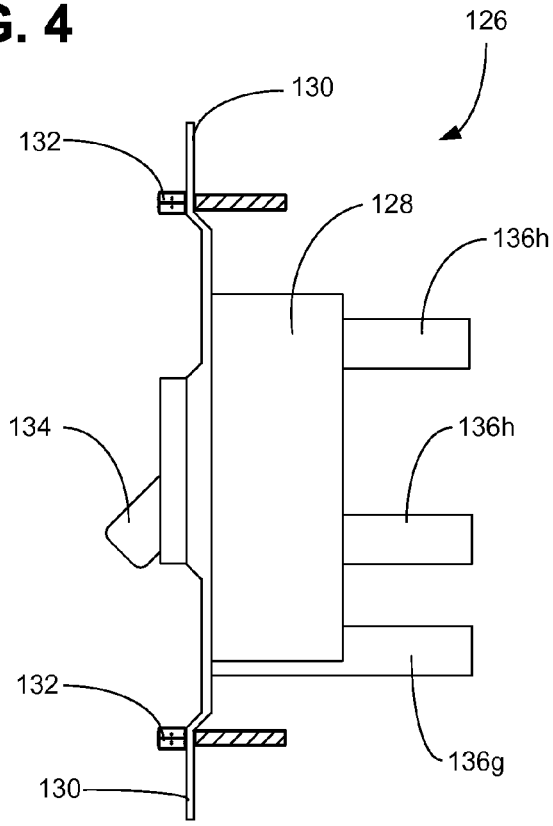
FIG. 6 is a side view of the single switch fitting of FIG. 4.

A first preferred embodiment of the fitting 104 is depicted in FIGS. 4-6, which provide bottom, front and right side views, respectively, of a single switch jack 126 constructed in accordance with a preferred embodiment of the invention. The single switch jack 126 includes a body 128, a connection plate 130, mounting screws 132 and a switch 134.

In many ways, the single switch jack 126 resembles a standard switch. Like a standard switch, the single switch jack 126 includes internal circuits within the body 128 that selectively permit and prohibit the flow of electricity through the single switch jack 126 in response to manipulation of the switch 134. Unlike prior art switches, however, the single switch jack 126 further includes a ground prong 136*g* and a pair of hot prongs 136*h* (collectively "prongs 136") extending from the body 128 in place of the lugs or wires employed by the prior art. Each of the prongs 136 is spaced and configured to be received in the corresponding receptacles 124 in the single switch box 106. Specifically, the ground prong 136*g* is configured to be received by the ground receptacle 124*g*. The pair of hot prongs 136*h* are configured to be received by the hot receptacles 124*h*.

To install the single switch jack 126, the single switch jack 126 is inserted into the single switch box 106 such that the prongs 136 are securely captured within the corresponding receptacles 124. Once the single switch jack 126 is installed into the single switch box 106, the operation of the switch 134 will open or close the circuit between the split hot contact bar 122*h*.

The relative dimensions of the prongs 136 and receptacles 124 are preferably configured to provide a secure connection while permitting the single switch jack 126 to be inserted into the single switch box 106 at varying depths. In a highly preferred embodiment, the prongs 136 and receptacles 124 are positioned within the single switch jack 126 and single switch box 106, respectively, such that the single switch jack 126 can only be installed in the intended orientation to eliminate potentially dangerous installation errors. The single switch jack 126 can be further secured to the single switch box 106 through the use of optional retaining screws 132.

When replacement of the single switch jack 126 is desired, the retaining screws 132 can be removed and the single switch jack 126 pulled out of the single switch box 106. The ease with which the single switch jack 126 can be removed from the single switch box 106 facilitates the inspection of the wiring between the electrical wiring system and the single switch box 106.

Figure 7:
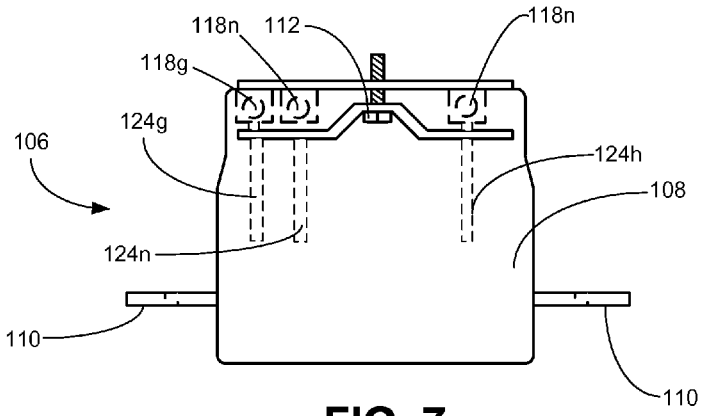
FIG. 7 is a bottom view of a single outlet fitting constructed in accordance with a preferred embodiment.
Figure 8:
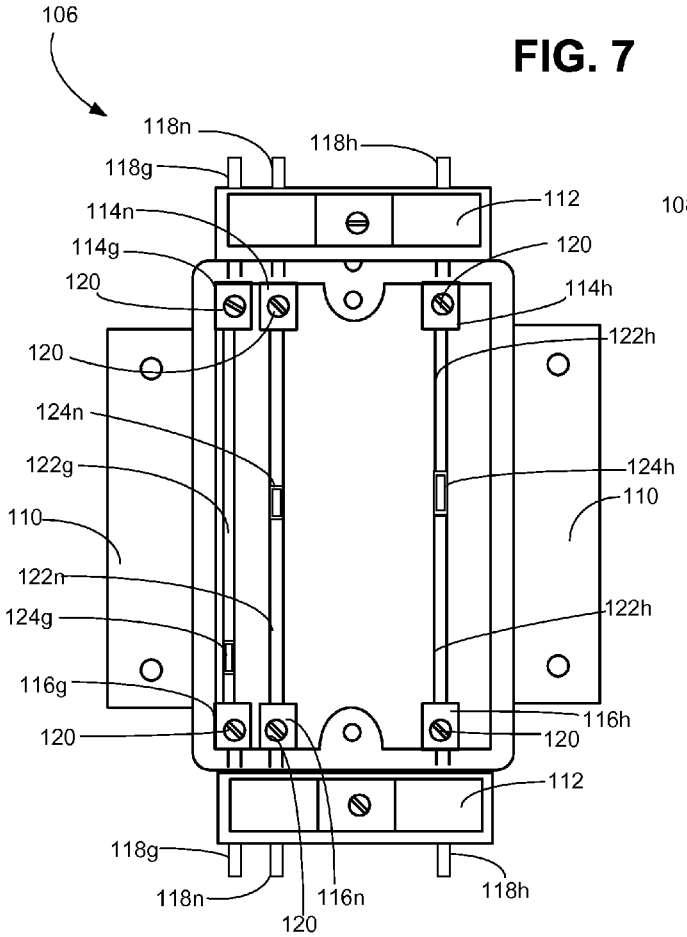
FIG. 8 is a front view of the single outlet fitting of FIG. 7.
Figure 9:
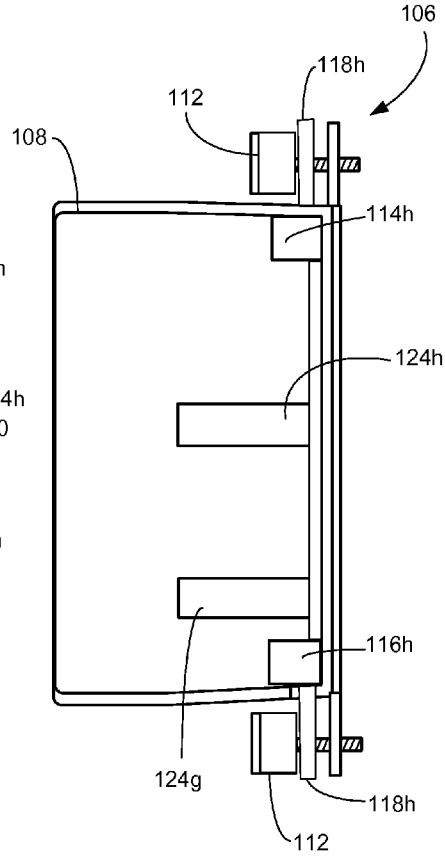
FIG. 9 is a side view of the single outlet fitting of FIG. 7.

In the embodiment depicted in FIGS. 7-9, the circuit box 102 is configured as a single outlet box 138. FIGS. 7-9 provide top, front and right side views, respectively of the single outlet box 138. The construction of the single outlet box 138 mirrors the construction of the single switch box 106 except that the contact bar 122*h* between the hot lugs 114*h* and 116*h* is not separated and the neutral contact bar 122*n* includes a receptacle 124*n*.

Figure 10:
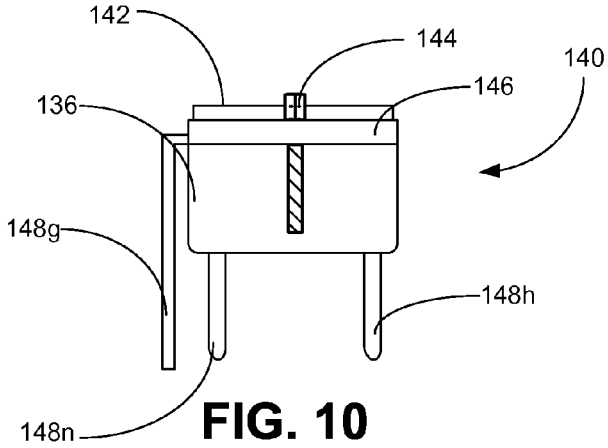
FIG. 10 is a top cross-sectional view of a single outlet box constructed in accordance with a preferred embodiment.
Figure 11:
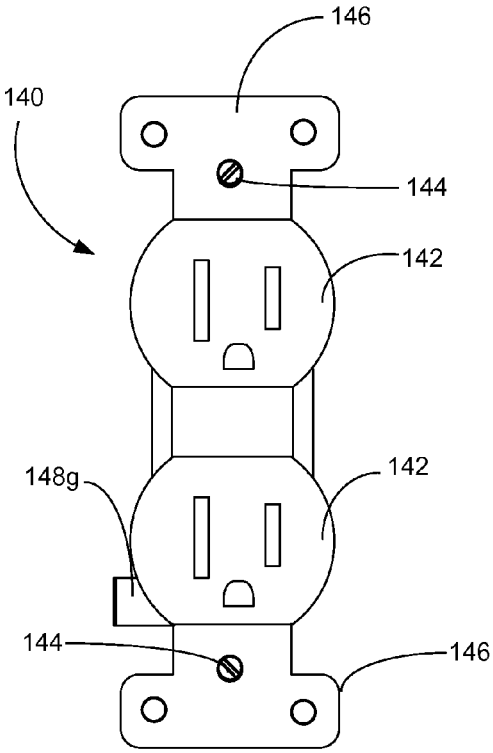
FIG. 11 is a front view of the single outlet box of FIG. 10.
Figure 12:
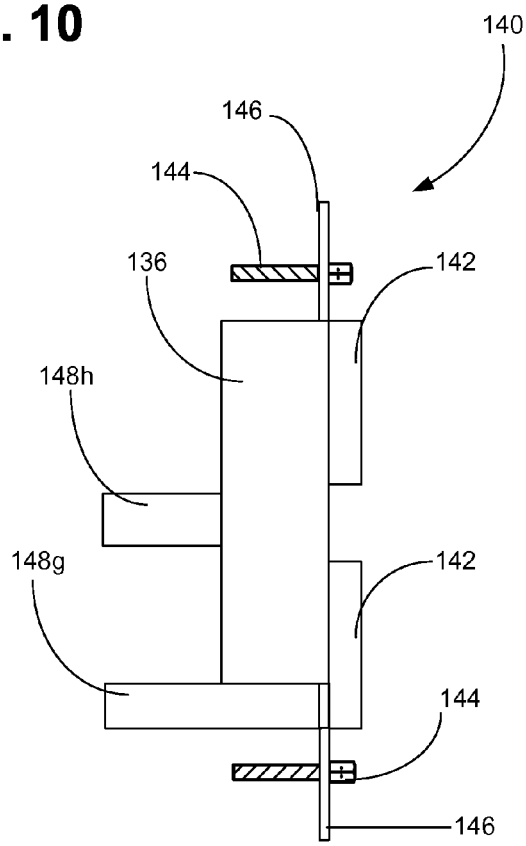
FIG. 12 is a side partial cut-away view of the single outlet box of FIG. 10.

In the embodiment depicted in FIGS. 10-12, the fitting 104 is configured as a single outlet jack 140. FIGS. 10-12 provide bottom, front and right side views, respectively, of the single outlet jack 140. The single outlet jack 140 includes a body 136, a pair of appliance plug receptacles 142, retaining screws 144 and retaining flanges 146. The single outlet jack 140 resembles a standard outlet, except that it further includes a ground prong 148*g*, a neutral prong 148*n* and a hot prong 148*h* (collectively "prongs 148") extending from the body 136 in place of the lugs or wires employed by the prior art. Each of the prongs 148 is spaced and configured to be received in the corresponding receptacles 124 in the single outlet box 138. To install the single outlet jack 140, the single outlet jack 140 is inserted into the single outlet box 138 such that the prongs 148 are securely captured within the corresponding receptacles 124. Retaining screws may be used further secure the single outlet jack within the single outlet box. The single outlet jack 140 may be easily removed from the single outlet box 138 for replacement or inspection.

Figure 13:
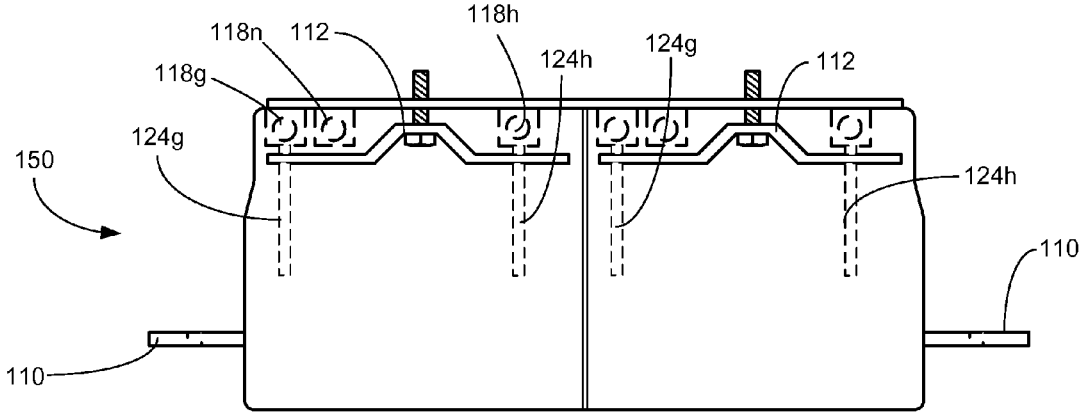
FIG. 13 is a top view of a double switch box constructed in accordance with a preferred embodiment of the present invention.
Figure 14:
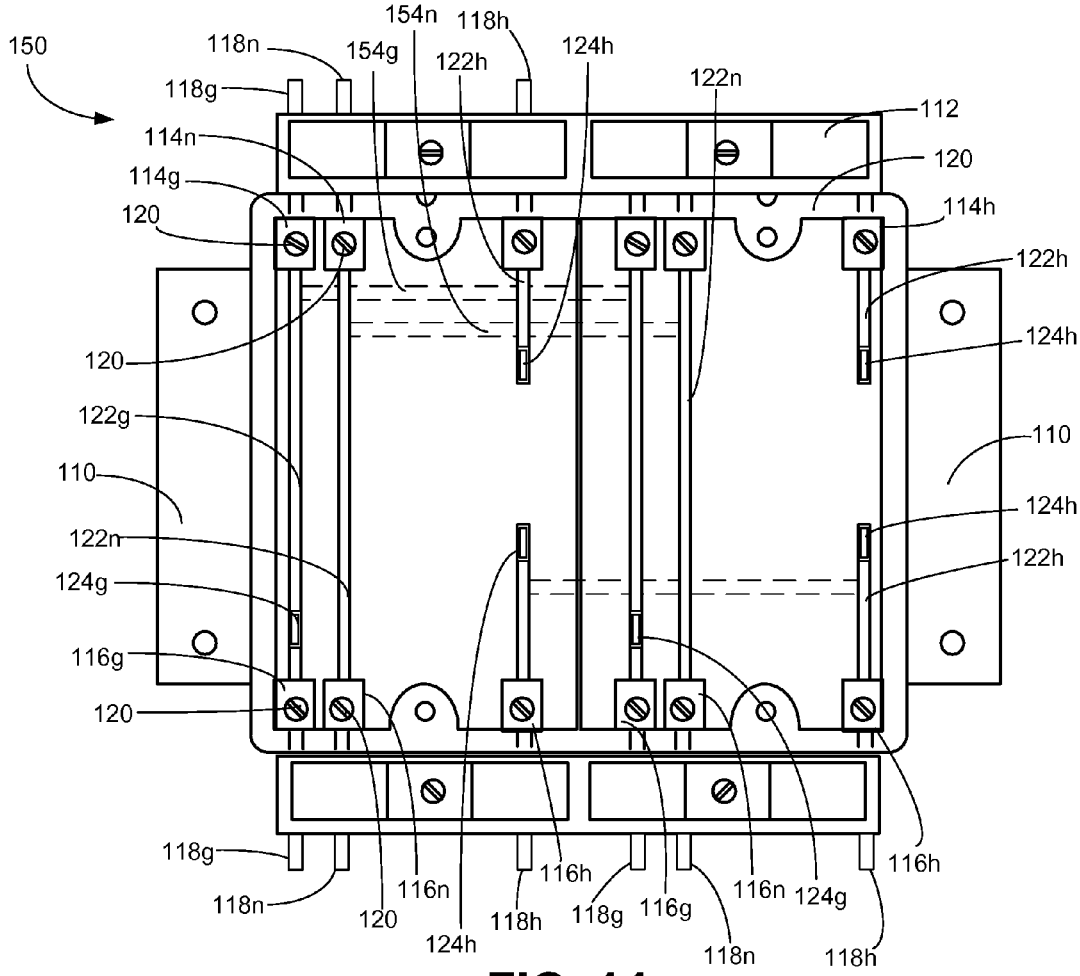
FIG. 14 is a front view of the double switch box of FIG. 14.
Figure 15:
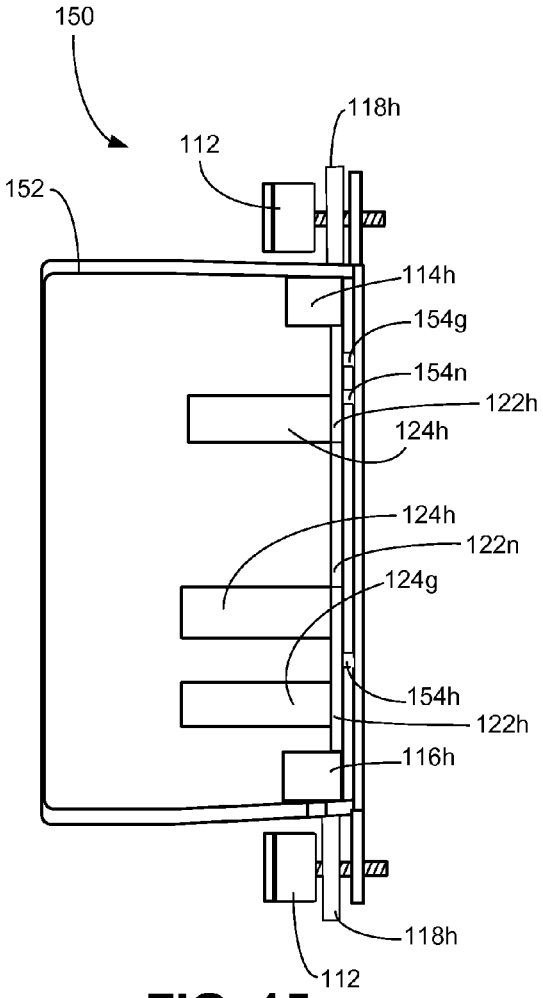
FIG. 15 is a side partial cut-away view of the double switch box of FIG. 14.

Turning to FIGS. 13-15, shown therein are top, front and right side views, respectively, of a double switch box 150 constructed in accordance with a preferred embodiment of the circuit box 102. The double switch box 150 essentially includes two of the single switch boxes 106 described above within a single enclosure 152. In the preferred embodiment, however, the ground contact bar 122*g*, neutral contact bar 122*n* and split hot contact bars 122*h* of each switch are connected by insulated bus bars 154*g*, 154*n* and 154*h*, respectively, shown in dashed lines in FIG. 14. (collectively "bus bars 154"). The use of bus bars 154 eliminates the need to splice and connect the input wires 118 from electrical wiring system to both switches.

Figure 16:
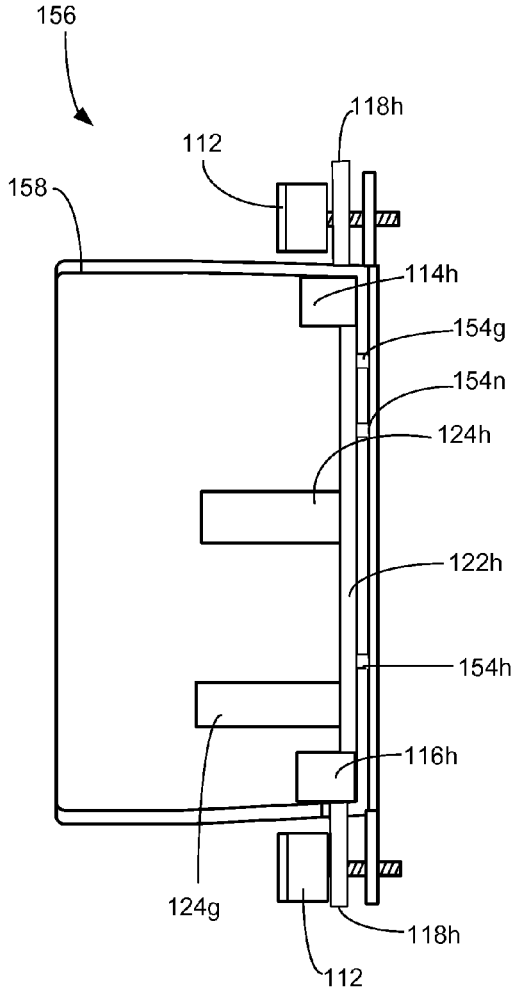
FIG. 16 is a top view of a double outlet box constructed in accordance with a preferred embodiment.
Figure 17:
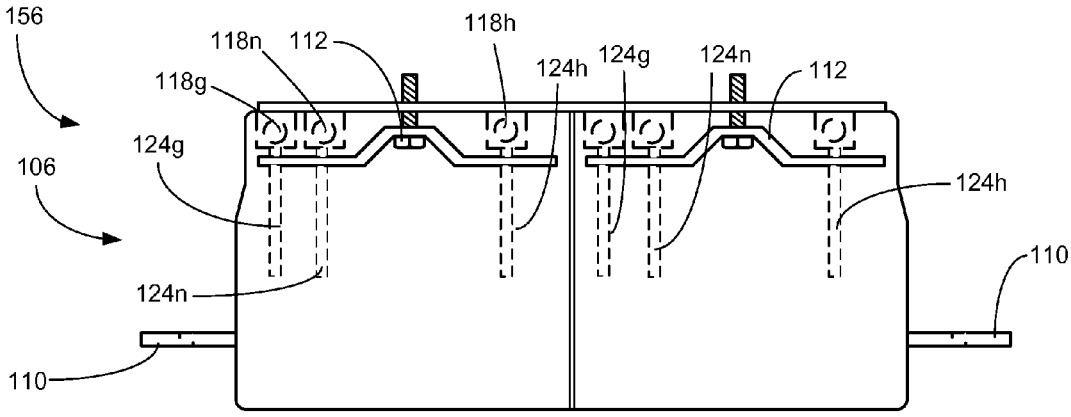
FIG. 17 is a front view of the double outlet box of FIG. 17.
Figure 18:
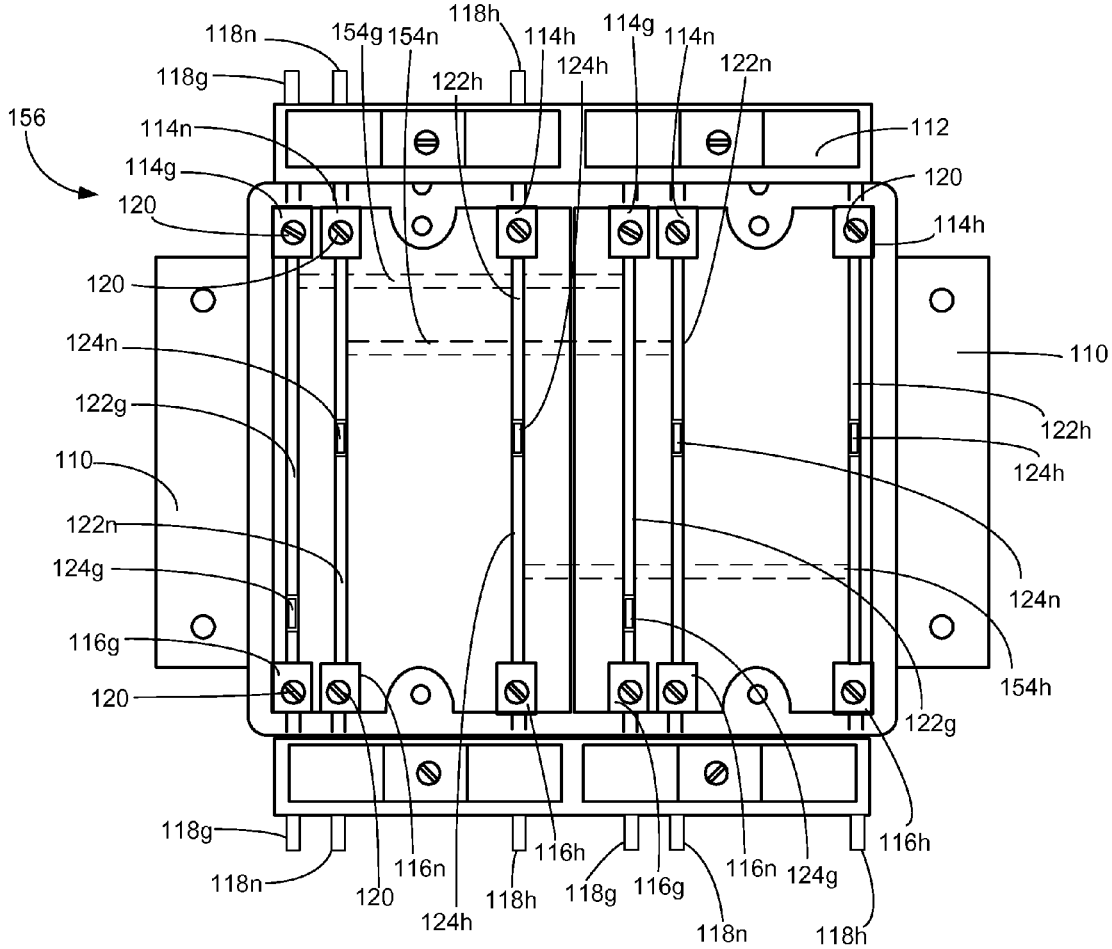
FIG. 18 is a side partial cut-away view of the double outlet box of FIG. 17.

Similarly, FIGS. 16-18 provide right side, top and front, respectively, of a double outlet box 156 constructed in accordance with a preferred embodiment of the circuit box 102. The double outlet box 156 essentially includes two of the single outlet box 138 described above within a single enclosure 158. In the preferred embodiment, however, the ground contact bar 122*g*, neutral contact bar 122*n* and hot contact bar 122*h* of each outlet are connected by insulated bus bars 154*g*, 154*n* and 154*h*, respectively. The use of bus bars 154 eliminates the need to splice and connect the input wires 118 from electrical wiring system to both outlets.

Figure 19:
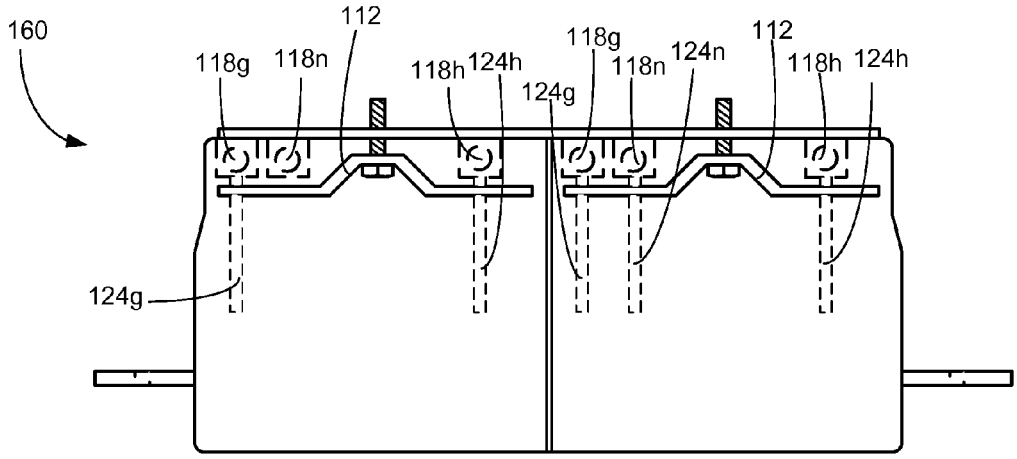
FIG. 19 is a top view of an outlet/switch combination box constructed in accordance with a preferred embodiment of the present invention.
Figure 20:
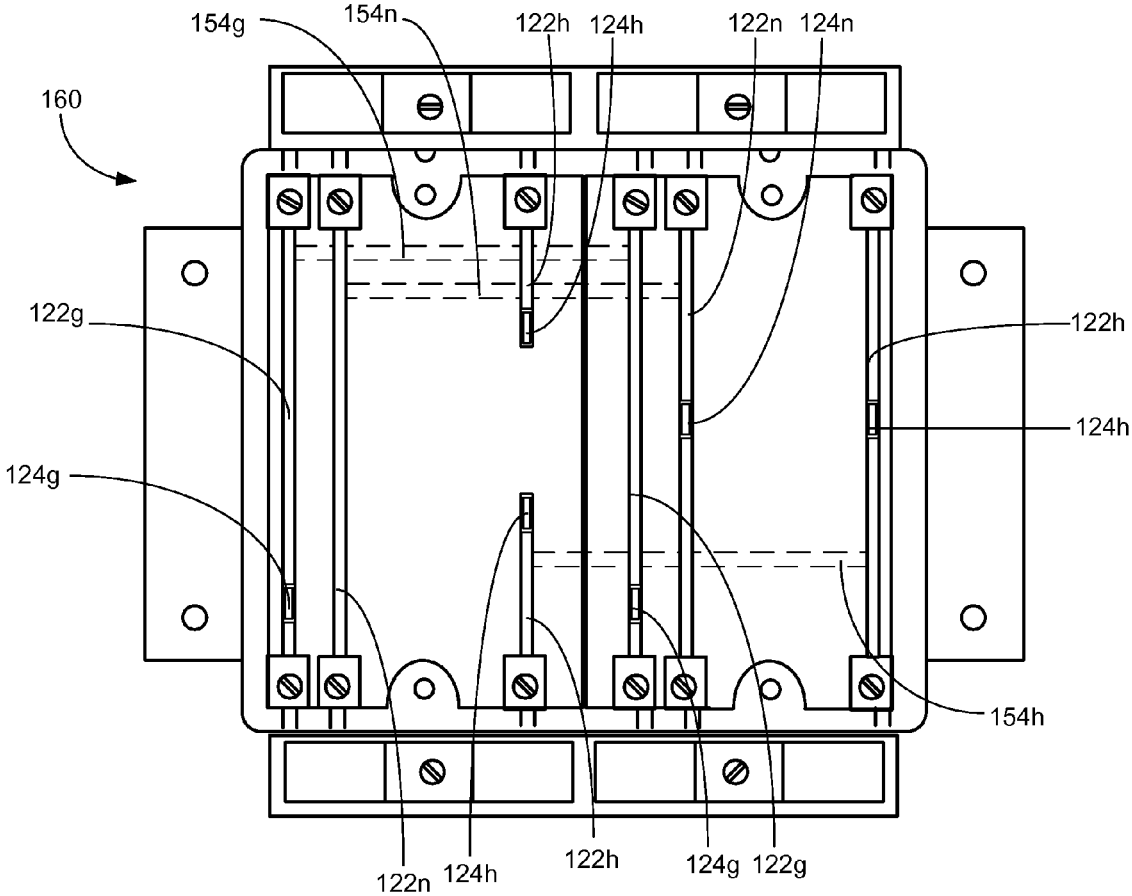
FIG. 20 is a front view of the outlet/switch combination box of FIG. 20.
Figure 21:
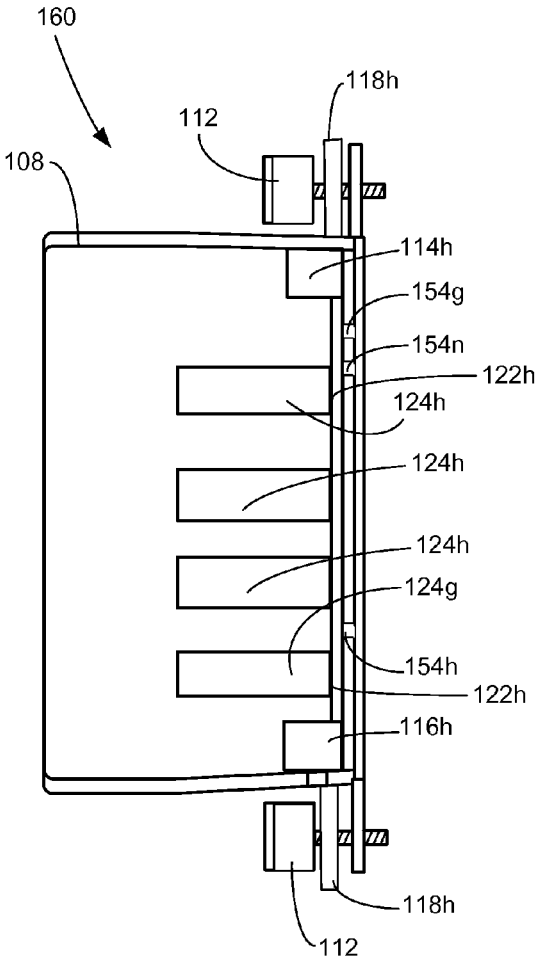
FIG. 21 is a side view of the outlet/switch combination box of FIG. 20.

Turning to FIGS. 19-21, shown therein are top, front, and right side views, respectively, of a switch and outlet combination box 160. In this embodiment, the circuit box 102 includes the components found in the single switch box 106 and the components found in the single outlet box 138. The ground contact bar 122*g*, the neutral contact bar 122*n* and the hot contact bar 122*h* of the switch side of the combination box 160 are connected to the corresponding ground contact bar 122*g*, neutral contact bar 122*n* and unitary hot contact bar 122*h* of the outlet side with insulated or embedded bus bars 154*g*, 154*n* and 154*h*, respectively, as disclosed above.

Figure 22:
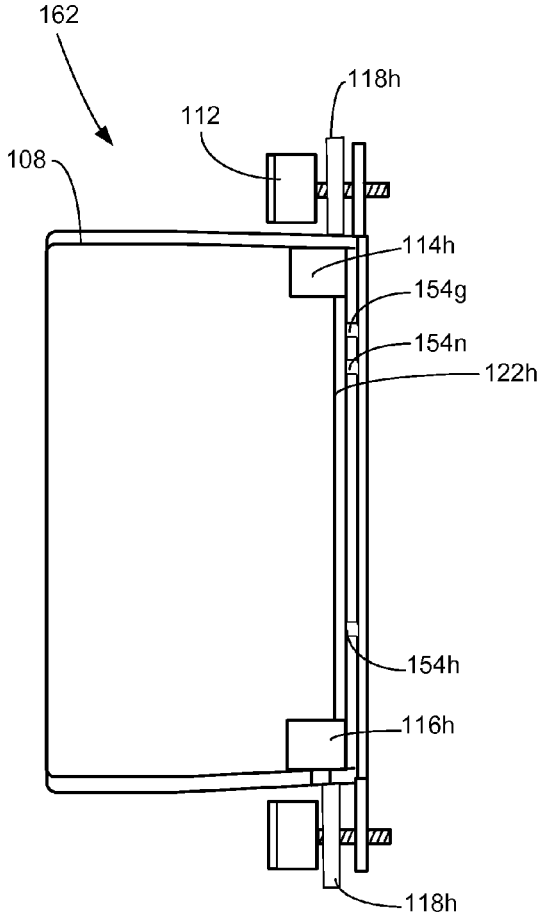
FIG. 22 is a top view of a double junction box constructed in accordance with a preferred embodiment.
Figure 23:
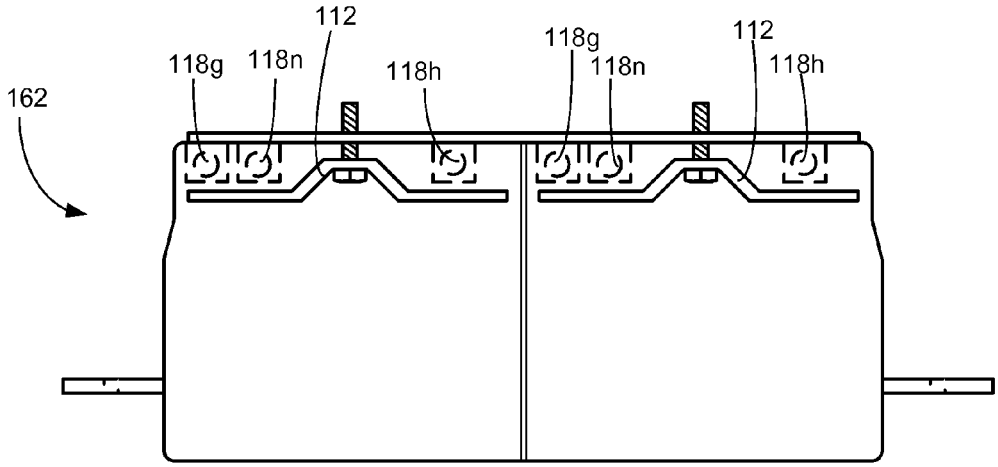
FIG. 23 is a front view of the double junction box of FIG. 23.
Figure 24:
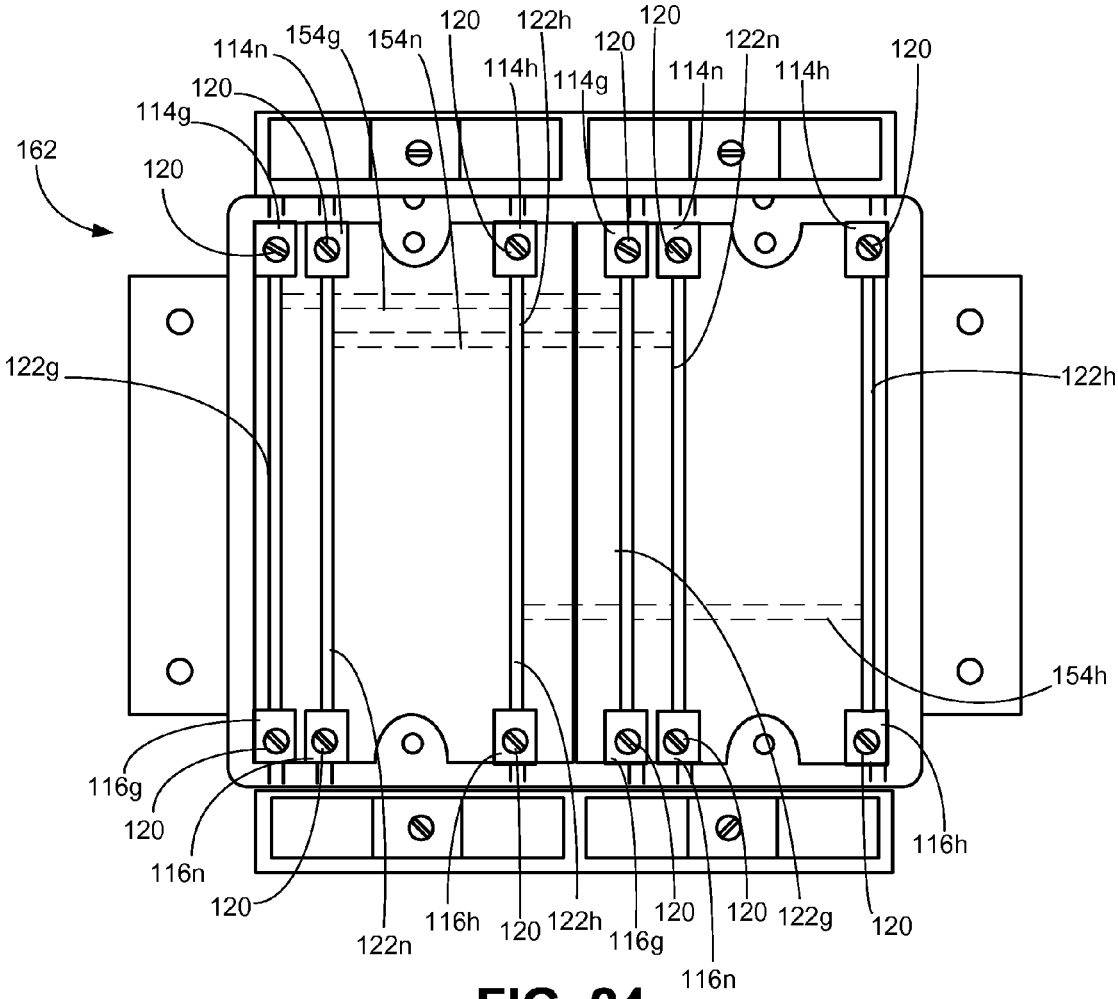
FIG. 24 is a side view of the double junction box of FIG. 23.

Turning to FIGS. 22-24, shown therein are right side, top, and front views, respectively, of a junction box 162 constructed in accordance with a preferred embodiment of the circuit box 102. The junction box 162 does not include receptacles 124 and is not intended to be used in combination with a switch, outlet or other fitting 104. The junction box 162 includes wire clamps 112 at the top and bottom of the housing 108 which are capable of accepting the stripped ends of the ground 118*g*, neutral 118*n* and hot 118*h* output wires, respectively, to the electrical wiring system. The ends of the wires are supported by the clamp 112 and secured to respective lugs 114 with screws 120. The corresponding ground, neutral and hot contact bars 122*g*, 122*n* and 122*h* are connected by insulated bus bars 154*g*, 154*n* and 154*h*, respectively. The use of bus bars 154 permits the connection of a single set of ground, neutral and hot input wires 118 to the junction box 162.

Figure 25:
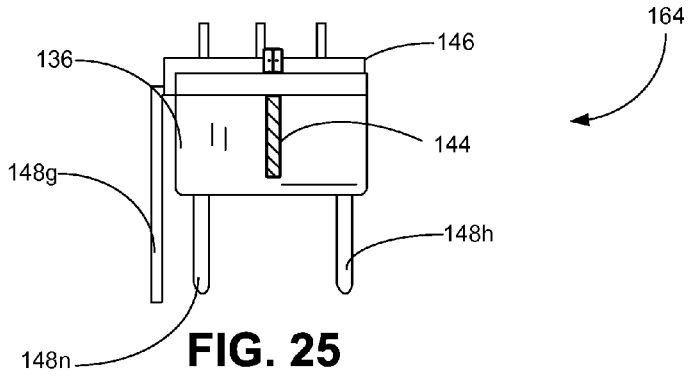
FIG. 25 is a bottom view of a generic fixture jack constructed in accordance with a preferred embodiment.
Figure 26:
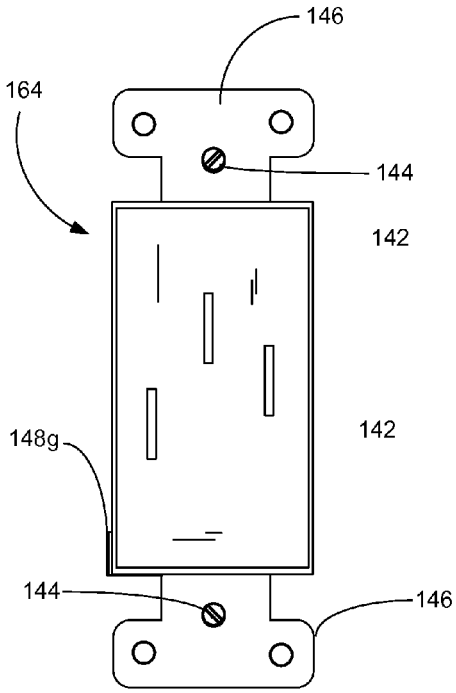
FIG. 26 is a front view of the generic fixture jack of FIG. 25.
Figure 27:
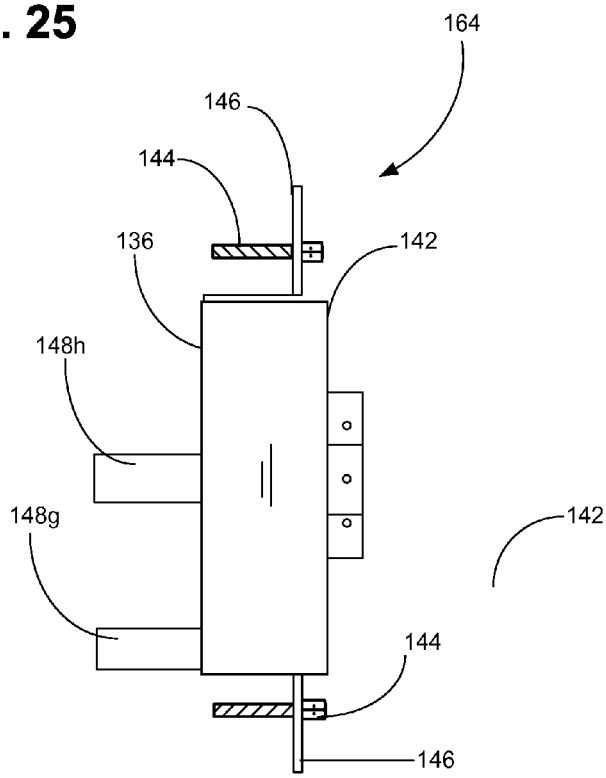
FIG. 27 is a side view of the generic fixture jack of FIG. 25.

Although the fitting 104 has been described above as a single outlet jack 140 and a single switch jack 126, it will be understood by those of skill in the art that the fitting 104 can easily be configured for use in ceiling fans, rheostats, smoke detectors, light fixtures, exhaust vents and intake vents or any other electrical appliance or fixture that could otherwise be hardwired into a conventional wiring system. The modularity of the design of the fittings 104 and the circuit box 102 permit the facilitated exchange of different fittings 104 within a single circuit box 102. For example, in FIGS. 25-26, which provide bottom, front and right side views, respectively, the fitting 104 is embodied by a generic fixture jack 164. The generic fixture jack 164 is configured to be integrated into an appliance or fixture during manufacture of the fixture or as a separate after-market adapter.

Like the single outlet jack 140, the generic fixture jack 164 includes a body 136, a pair of retaining flanges 146, retaining screws 144, a ground prong 148*g*, a neutral prong 148*n* and a hot prong 148*h*. Additionally, the generic fixture jack 164 includes a ground lead 166*g*, a neutral lead 166*n* and a hot lead 166*h* (collectively "leads 166") extending from the body 136. The ground lead 166*g*, neutral lead 166*n* and hot lead 166*h* are connected by embedded conductors with the ground prong 148*g*, neutral prong 148*n* and hot prong 148*h*, respectively. The leads 166 are configured to be wired into a fixture with suitable electrical connectors or wires. It will be appreciated by those of skill in the art that some fixtures may not make use of ground, neutral and hot connections.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms used herein and in the appended claims.

It will be appreciated by those skilled in the art that the teachings of the present invention can be applied to other systems without departing from the scope and spirit of the present invention. For example, although various combinations of switch, outlet and junction boxes have been disclosed herein, it will be understood that numerous other embodiments of the present invention can be created using the fundamental concept of connecting to an electrical wiring system a circuit box capable of receiving a suitable fixture in a removable plug-and-socket relationship. It will be noted that although the various circuit boxes disclosed herein have been illustrated and described as having female receptacles and the corresponding fixtures described as having male prongs, it will be appreciated that the scope of this invention includes those alternate embodiments in which the fixture includes female receptacles that are configured to receive male prongs attached to contact bars in the circuit box.

It is claimed:

1. A modular circuit system for use in an electrical wiring system, the modular circuit system comprising:

a circuit box configured to be connected into the electrical wiring system, wherein the circuit box comprises a single switch box that comprises:

a housing;

a first plurality of wire lugs on a first side of the circuit box, wherein the first plurality of lugs includes a first ground lug, a first neutral lug and a first hot lug;

a second plurality of wire lugs on a second side of the circuit box, wherein the second plurality of lugs includes a second ground lug, a second neutral lug and a second hot lug;

a plurality of contact bars connected between the first plurality of wire lugs and the second plurality of wire lugs, wherein the plurality of contact bars comprises:

a ground contact bar extending between the first ground lug and the second ground lug;

a neutral contact bar extending between the first neutral lug and the second neutral lug;

a first hot contact bar extending from the first hot lug;

a second hot contact bar extending from the second hot lug; and a plurality of prong receptacles, wherein each of the plurality of prong receptacles is connected to a corresponding contact bar and wherein the plurality of prong receptacles includes:

a ground prong receptacle connected to the ground contact bar;

a first hot prong receptacle connected to the first hot contact bar;

a second hot prong receptacle connected to the second hot contact bar; and a fitting configured to be removably inserted into the circuit box; wherein the fitting comprises:

a base; and a plurality of prongs extending from the base, wherein each of the prongs is configured to be received by a corresponding one of the plurality of prong receptacles, thereby placing the fitting in electrical communication with the circuit box.

2. The modular circuit system of claim 1, wherein the fitting comprises a single switch jack that includes:

a body;

a toggle switch;

a ground prong extending from the body;

a pair of hot prongs extending from the body; and wherein the toggle switch selectively opens and closes the circuit between the pair of hot prongs.

* * * * *

UNITED STATES PATENT AND TRADEMARK OFFICE

CERTIFICATE OF CORRECTION

PATENT NO. : 7,744,407 B1
APPLICATION NO. : 12/417304
DATED : June 29, 2010
INVENTOR(S) : Jerry Blurton It is certified that error appears in the above-identified patent and that said Letters Patent is hereby corrected as shown below:

Title Page, Item (76) Inventor:
The Inventor name should be "Jerry Blurton."
Column 3, Line 47 should read "122n provide."

Signed and Sealed this

Fourteenth Day of September, 2010

David J. Kappos

David J. Kappos
*Director of the United States Patent and Trademark Office*